US010630018B1

(12) United States Patent
Yang et al.

(10) Patent No.: US 10,630,018 B1
(45) Date of Patent: Apr. 21, 2020

(54) WATERPROOF CONNECTOR

(71) Applicant: Cheng Uei Precision Industry Co., Ltd., New Taipei (TW)

(72) Inventors: Yu Lin Yang, New Taipei (TW); Feng Tian Liu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 16/455,819

(22) Filed: Jun. 28, 2019

Related U.S. Application Data

(60) Provisional application No. 62/773,847, filed on Nov. 30, 2018.

(30) Foreign Application Priority Data

Jan. 18, 2019 (CN) ..... 2019 2 0089151 U

(51) Int. Cl.
*H01R 13/52* (2006.01)
*H01R 12/70* (2011.01)
*H01R 12/72* (2011.01)

(52) U.S. Cl.
CPC ..... *H01R 13/52* (2013.01); *H01R 12/707* (2013.01); *H01R 12/721* (2013.01)

(58) Field of Classification Search
CPC ..... H01R 13/52; H01R 12/707; H01R 12/721
See application file for complete search history.

(56) References Cited

U.S. PATENT DOCUMENTS 5,584,708 A * 12/1996 Leong ..... H01R 12/721 439/79
6,790,055 B1 * 9/2004 Shiu ..... H01R 12/57 439/260
6,953,350 B2 * 10/2005 Shiu ..... H01R 12/87 439/79
7,677,917 B2 * 3/2010 Hemmi ..... H01R 12/88 439/495
7,950,965 B2 * 5/2011 Cao ..... H01R 4/028 439/660
9,698,537 B2 * 7/2017 Yokoyama ..... H01R 13/648
2008/0293262 A1 * 11/2008 Duesterhoeft ..... H01R 12/78 439/65

(Continued)

*Primary Examiner* — Harshad C Patel
(74) *Attorney, Agent, or Firm* — Lin & Associates Intellectual Property, Inc.

(57) ABSTRACT

A waterproof connector includes an insulating housing integrally molded, a plurality of terminals, a fastening element and an outer shell. The insulating housing has a connecting end, and an assembling end connected with the connecting end. The insulating housing opens a penetrating groove penetrating through the connecting end and the assembling end. An insertion groove is opened in a rear end of the assembling end. The plurality of terminals are assembled in the penetrating groove. Each terminal has a main portion, a lying U-shaped soldering portion connected with one end of the main portion, and a lying U-shaped contact portion connected with the other end of the main portion. The fastening element includes an isolation part inserted into the insertion groove. The soldering portion of each terminal clamps a top surface and a bottom surface of the isolation part. The outer shell surrounds the insulating housing.

20 Claims, 10 Drawing Sheets

(56) References Cited

U.S. PATENT DOCUMENTS

| | | | | |
|---|---|---|---|---|
| 2013/0178075 | A1* | 7/2013 | Hsueh | H01R 12/721<br>439/62 |
| 2016/0156136 | A1* | 6/2016 | Kao | H01R 13/6585<br>439/607.05 |
| 2016/0344122 | A1* | 11/2016 | Kao | H01R 12/722 |
| 2017/0093076 | A1* | 3/2017 | Yokoyama | H01R 4/02 |

* cited by examiner

WATERPROOF CONNECTOR

CROSS-REFERENCE TO RELATED APPLICATION

This application claims the priorities of U.S. provisional patent application No. 62/773,847, filed on Nov. 30, 2018 and China patent application No. 201920089151.7, filed on Jan. 18, 2019, which are incorporated herewith by reference.

BACKGROUND OF THE INVENTION

1. Field of the Invention

The present invention generally relates to a connector, and more particularly to a waterproof connector having a simple structure and effectively achieving a waterproof effect.

2. The Related Art

With the continuous advance of electronic equipments, plug connectors have become essential accessory products of the electronic equipments, a compatibility of a waterproof performance, a safety performance and a fast charging performance of the plug connector has become a goal which enterprises achieve eagerly.

Among known plug connectors, a distance between a positive terminal and a negative terminal of each plug connector is very near, so that a creepage distance between the positive terminal and the negative terminal of each plug connector is short. A potential safety hazard of the fast charging performance of each plug connector is existed on account of the short creepage distance of the plug connector. Even in a later period of manufacturing the plug connector, after the plug connector is soldered to a circuit board, it often happens that the circuit board has an insufficient bearing force for supporting the circuit board, consequently, when the circuit board is soldered with an electric cable, the circuit board occurs a deformation phenomenon, a breakdown phenomenon or other phenomenons.

In waterproof structures of the known plug connectors which are waterproof connectors, moisture of external environments is prevented from being permeated into the known plug connector by means of a waterproof ring which is made of silicone epoxy resin and a waterproof structure formed by solid waterproof adhesives. Location structures to which terminals of the known plug connector are located penetrate through a front and a rear of the known plug connector, invisibly multiple clearances of the plug connector are increased, and then a probability of the moisture of the external environments entering the plug connector is increased, and a normal usage and a usage life of the plug connector are affected. Though the waterproof ring and the waterproof structure formed by the solid waterproof adhesives are used in the plug connector, interstices of a shell of the plug connector are hardly conquered completely. Moreover, the known plug connector exists certain hazards on requirements of the fast charging performance and the safety performance which are more and more popular, and the plug connector has a complex manufacture procedure and a cost of manufacturing the plug connector is higher. As a result, the waterproof connector has a complex structure and is without achieving a waterproof effect.

SUMMARY OF THE INVENTION

An object of the present invention is to provide a waterproof connector. The waterproof connector includes an insulating housing integrally molded, a plurality of terminals, a fastening element and an outer shell. The insulating housing has a connecting end, and an assembling end connected with the connecting end. The insulating housing opens a penetrating groove penetrating through a front and two opposite sides of the connecting end, and a rear end and two opposite sides of the assembling end. Two portions of inner surfaces of a top wall and a bottom wall of the penetrating groove protrude towards each other to form two protruding boards projecting into the penetrating groove. The connecting end has a hollow connecting portion of which a front is opened freely. The two protruding boards are located next to an inner side of the connecting portion. An insertion groove is opened in and penetrates through a middle of a rear end of the assembling end. The insulating housing includes a first protruding rib protruded upward from a rear end of a top surface of a top wall of the insertion groove, and a second protruding rib protruded downward from a rear end of a bottom surface of a bottom wall of the insertion groove and opposite to the first protruding rib. The plurality of terminals are assembled in the penetrating groove. Each terminal has a main portion disposed vertically, a lying U-shaped soldering portion connected with one end of the main portion and extending outward, and a lying U-shaped contact portion connected with the other end of the main portion, and extending outward and disposed opposite to the soldering portion. The soldering portion has a clamping performance. The fastening element includes an isolation part inserted into a middle of the insertion groove. The fastening element includes a clamping portion passing through the insertion groove to project into a front end of the penetrating groove and playing a clamping function, and a propping portion connected with and opposite to the clamping portion, and the propping portion is exposed out from the insulating housing. The soldering portion of each terminal clamps a top surface and a bottom surface of the isolation part. The isolation part has a connecting block, and at least two isolation blocks intersecting with the connecting block and projecting beyond a top surface and a bottom surface of the connecting block. The at least two isolation blocks are disposed among the plurality of the terminals. At least two terminals are isolated from the other terminals by the at least two isolation blocks. The outer shell surrounds the integrally molded insulating housing. The soldering portion of each terminal and the propping portion of the fastening element are exposed out of the outer shell.

Another object of the present invention is to provide a waterproof connector dapted for being mounted to a circuit board. The waterproof connector includes an insulating housing integrally molded, a plurality of terminals, a fastening element and an outer shell. The insulating housing has a connecting end, and an assembling end connected with the connecting end. The insulating housing opens a penetrating groove penetrating through a front and two opposite sides of the connecting end, and a rear end and two opposite sides of the assembling end. An insertion groove is opened in and penetrates through a middle of a rear end of the assembling end. The insulating housing includes a first protruding rib protruded upward from a rear end of a top surface of a top wall of the insertion groove, and a second protruding rib protruded downward from a rear end of a bottom surface of a bottom wall of the insertion groove and opposite to the first protruding rib. The plurality of the terminals are assembled in the penetrating groove. Each terminal has a main portion disposed vertically, a lying U-shaped soldering portion connected with one end of the main portion and extending outward, and a lying U-shaped contact portion connected with the other end of the main portion, and extending outward and disposed opposite to the soldering portion. The fastening element includes an isolation part inserted into a middle of the insertion groove. The fastening element includes a clamping portion projecting into a front end of the penetrating groove and playing a clamping function, and a propping portion connected with and opposite to the clamping portion, and the propping portion is exposed out from the insulating housing. The soldering portion of each terminal clamps a top surface and a bottom surface of the isolation part. The isolation part has a connecting block, and at least two isolation blocks intersecting with the connecting block and projecting beyond a top surface and a bottom surface of the connecting block. The at least two isolation blocks are disposed among the plurality of the terminals. The outer shell surrounds the insulating housing. The soldering portion of each terminal and the propping portion of the fastening element are exposed out of the outer shell. At least two portions of a top of the outer shell extend rearward to form at least two soldering feet adjacent to the propping portion. The at least two soldering feet are disposed opposite to and spaced from the propping portion. The circuit board is supported between the at least two soldering feet and the propping portion.

Another object of the present invention is to provide a waterproof connector. The waterproof connector includes an insulating housing integrally molded, a plurality of terminals, a fastening element and an outer shell. The insulating housing has a connecting end, and an assembling end connected with the connecting end. The insulating housing opens a penetrating groove penetrating through a front and two opposite sides of the connecting end, and a rear end and two opposite sides of the assembling end. The insulating housing has a plurality of spaced isolating boards disposed in the penetrating groove. The plurality of the spaced isolating boards are connected between rears of inner surfaces of a top wall and a bottom wall of the penetrating groove. A plurality of receiving slots are formed among the plurality of the spaced isolating boards. An insertion groove is opened in and penetrates through a middle of a rear end of the assembling end. The insulating housing includes a first protruding rib protruded upward from a rear end of a top surface of a top wall of the insertion groove, and a second protruding rib protruded downward from a rear end of a bottom surface of a bottom wall of the insertion groove and opposite to the first protruding rib. The plurality of the terminals are assembled in the penetrating groove. The plurality of the terminals are corresponding to and received in the plurality of the receiving slots. Each terminal has a main portion disposed vertically, a lying U-shaped soldering portion connected with one end of the main portion, and a lying U-shaped contact portion connected with the other end of the main portion and disposed opposite to the soldering portion. The fastening element includes an isolation part inserted into a middle of the insertion groove. The fastening element includes a clamping portion passing through the insertion groove to project into a front end of the penetrating groove and playing a clamping function, and a propping portion connected with and opposite to the clamping portion, and the propping portion is exposed out from the insulating housing. The soldering portion of each terminal clamps a top surface and a bottom surface of the isolation part. The isolation part has a connecting block, and at least two isolation blocks intersecting with the connecting block and projecting beyond a top surface and a bottom surface of the connecting block. The at least two isolation blocks are disposed among the plurality of the terminals. At least two terminals being isolated from the other terminals by the at least two isolation blocks.

As described above, the waterproof connector saves a procedure of dispensing a waterproof adhesive, and in order to prevent moisture of external environments permeating into the waterproof connector, the insulating housing having the plurality of the isolating boards and a blocking board is integrally molded, the plurality of the terminals are isolated from and away from the connecting portion of the connecting end by the two protruding boards, so that the plurality of the terminals are away from an outside of the waterproof connector, and an effect of decreasing the moisture of the external environments permeated into the plurality of the terminals of the waterproof connector from the connecting portion is reached, in addition, the two protruding boards project into the accommodating space of the waterproof connector, a clearance formed between the plurality of the terminals and an inside of the insulating housing is decreased, so that the effect of decreasing the moisture of the external environments permeated into the waterproof connector from the clearance. Thus, a normal usage and a usage life of the waterproof connector is affected. Furthermore, a creepage distance between a positive terminal assembly and a negative terminal assembly is increased on account of the positive terminal assembly being isolated from the negative terminal assembly by one isolation block, so a short circuit phenomenon between the positive terminal assembly and the negative terminal assembly is prevented being caused, in order to increase a creepage distance between the positive terminal assembly and the outer shell and improve a safety of using the waterproof connector, the insertion groove, the first protruding rib and the second protruding rib are exposed out of the outer shell. Because a combination design of the at least two soldering feet and the propping portion, when either of the top surface and the bottom surface of the circuit board is soldered with a cable, a deformation phenomenon or a breakage phenomenon of the circuit board is further reduced for improving a yield of the circuit board of which the waterproof connector is mounted on soldering with the cable. As a result, the waterproof connector has a simple structure and effectively achieves a waterproof effect.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
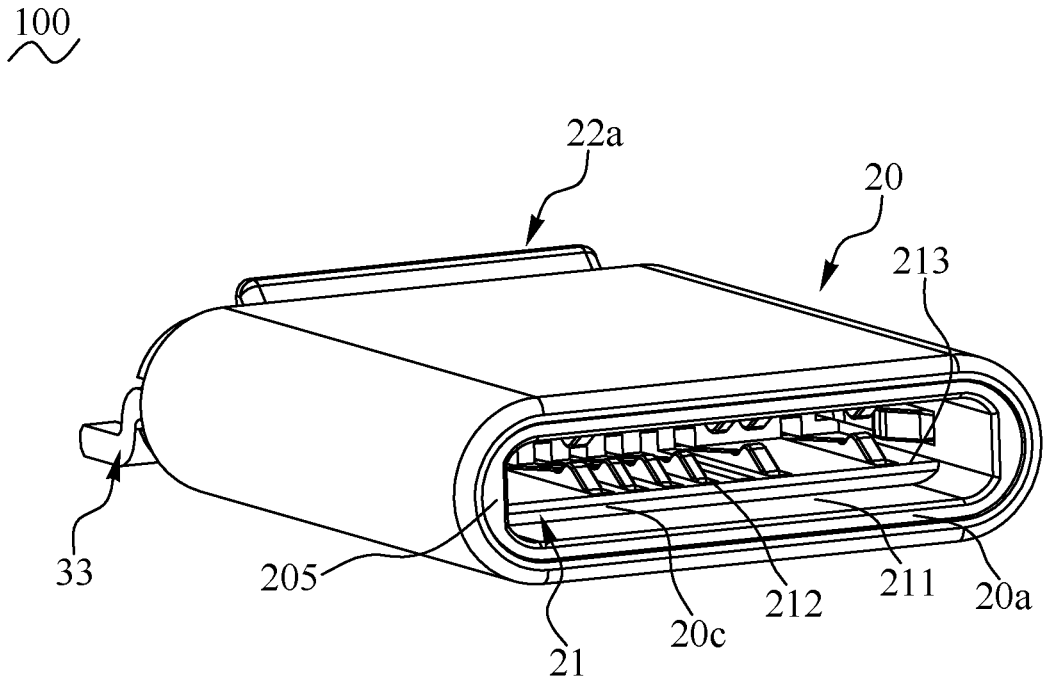
FIG. 1 is a perspective view of a waterproof connector in accordance with a first preferred embodiment of the present invention.
Figure 2:
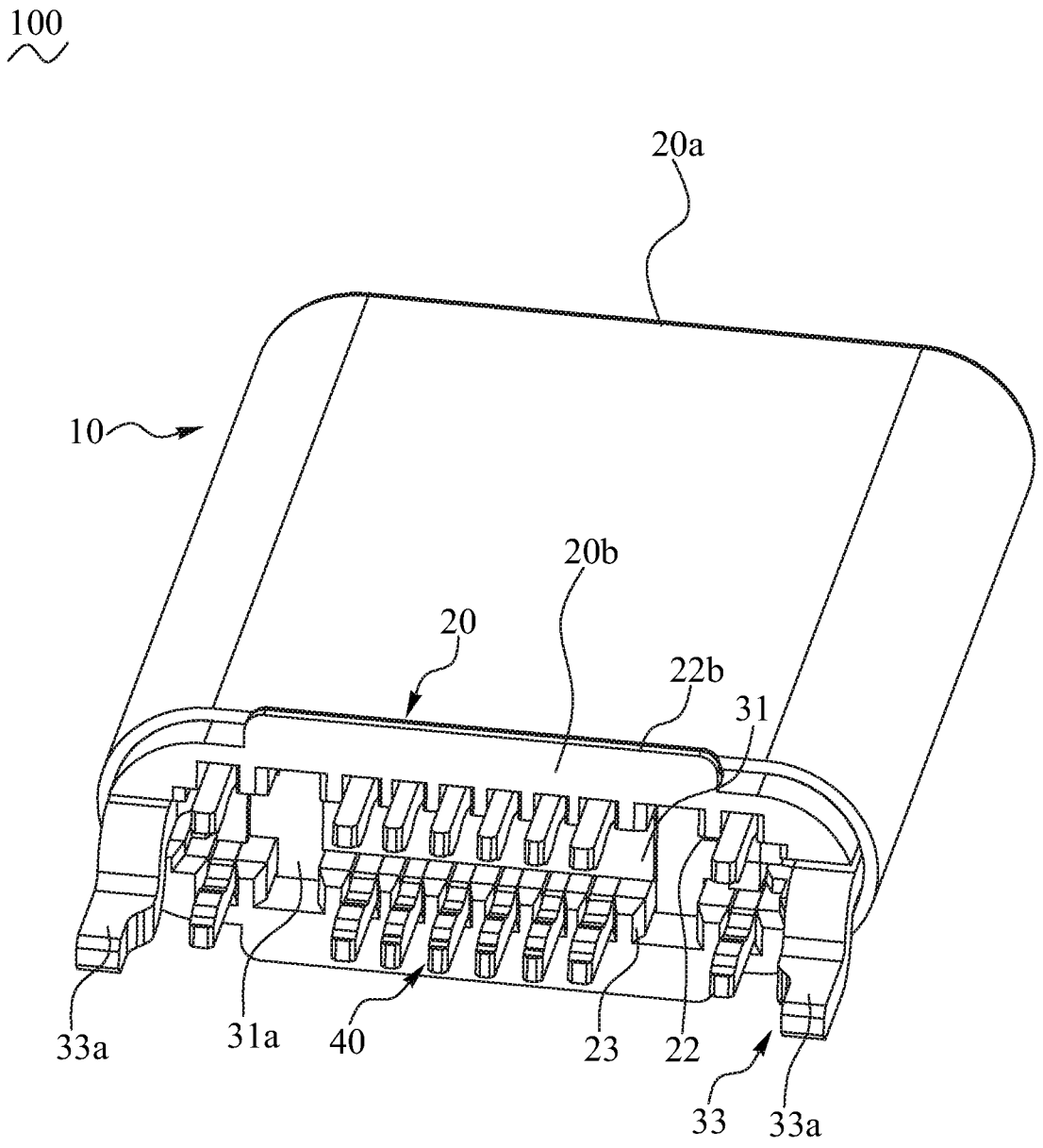
FIG. 2 is another perspective view of the waterproof connector of FIG. 1.
Figure 8:
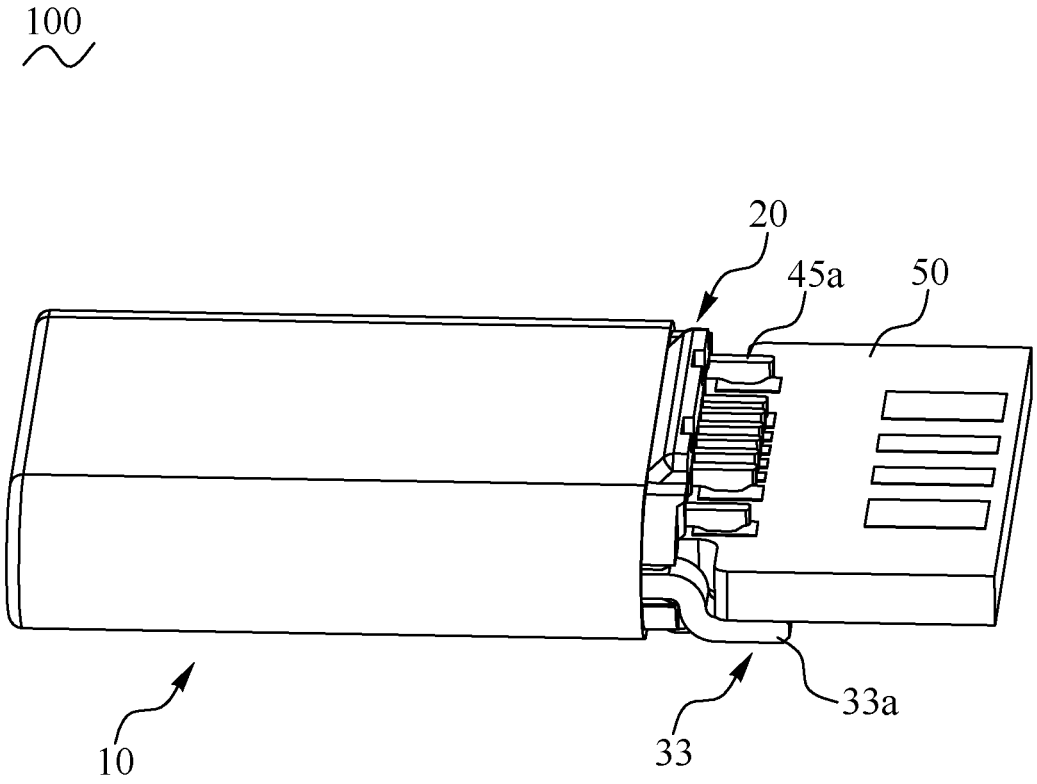
FIG. 8 is a perspective view showing that the waterproof connector in accordance with the first preferred embodiment is mounted on a circuit board.
Figure 9:
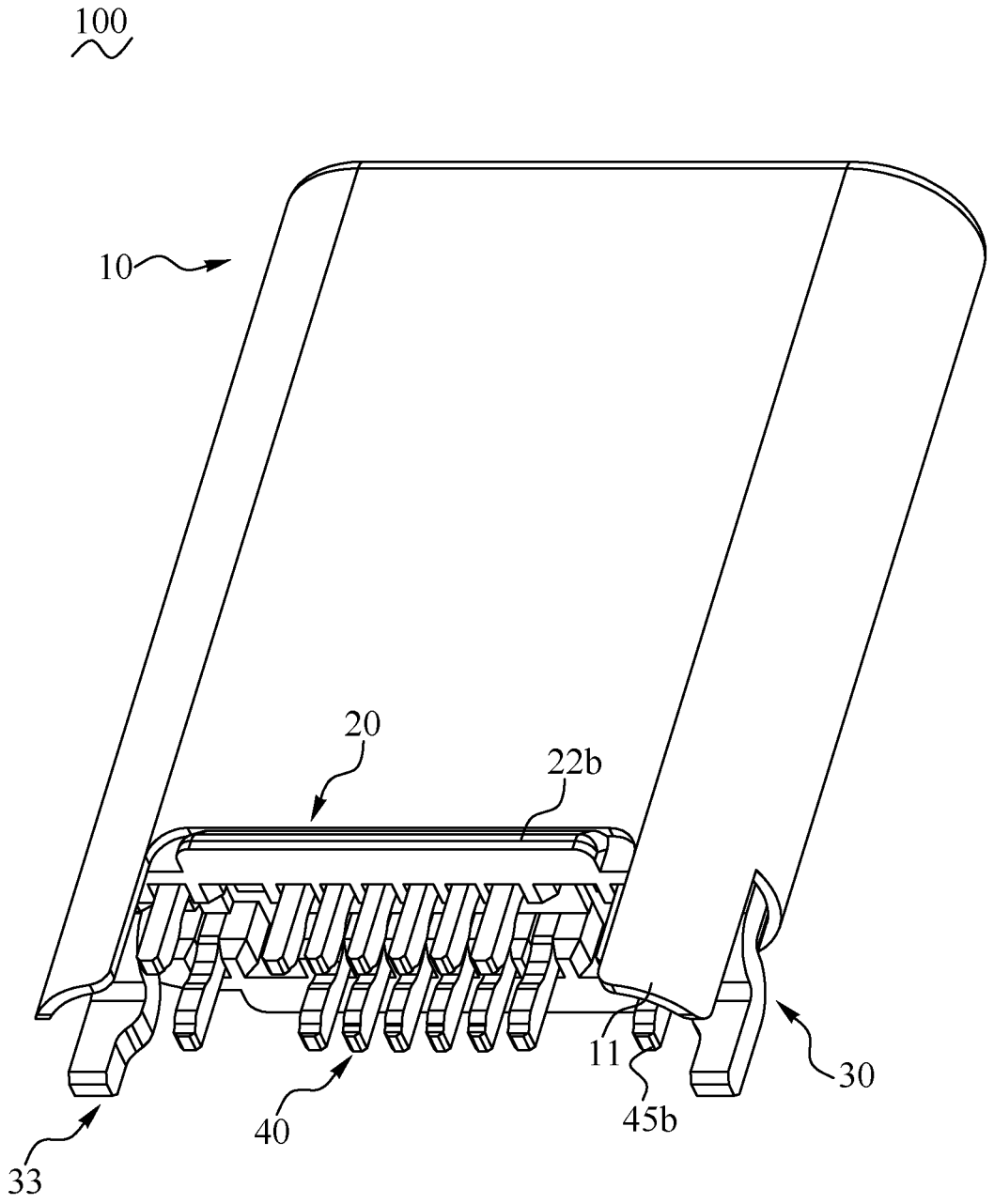
FIG. 9 is a perspective view of the waterproof connector in accordance with a second preferred embodiment of the present invention.
Figure 10:
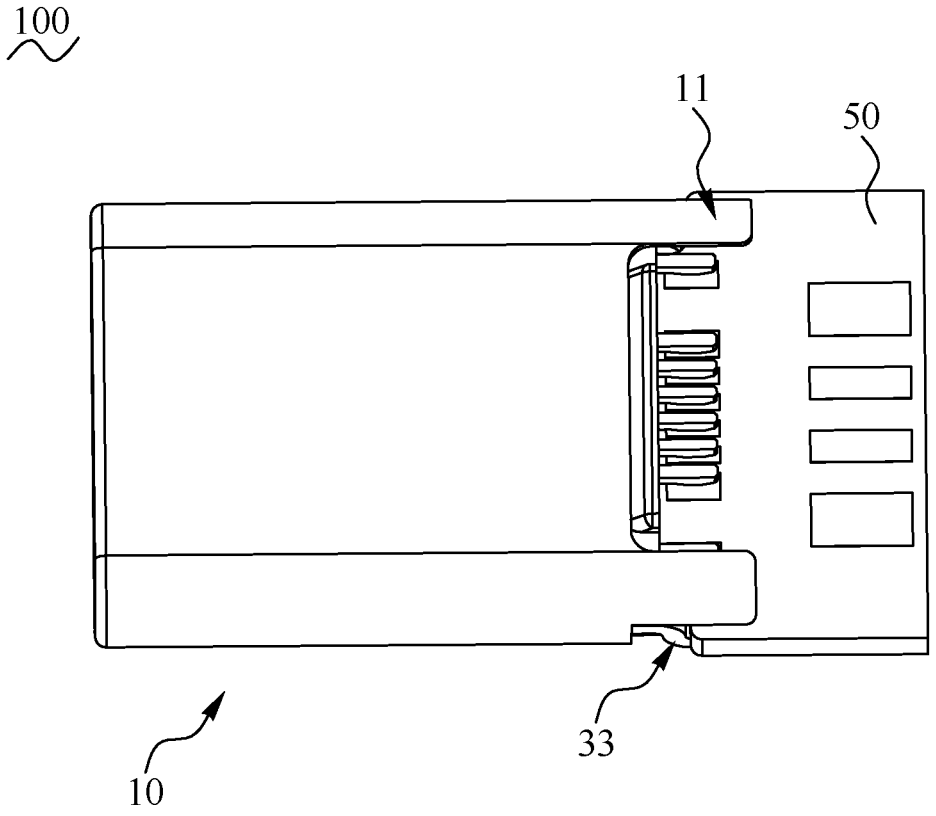
FIG. 10 is a perspective view showing that the waterproof connector in accordance with the second preferred embodiment is mounted on the circuit board.

With reference to FIG. 1, FIG. 2 and FIG. 8, a waterproof connector 100 in accordance with a first preferred embodiment of the present invention is shown. The waterproof connector 100 adapted for being mounted to a circuit board 50, includes an outer shell 10, an insulating housing 20, a fastening element 30 and a plurality of terminals 40.

Referring to FIG. 1 to FIG. 4, the insulating housing 20 is integrally molded. The insulating housing 20 has a connecting end 20*a* located at a front end of the insulating housing 20, and an assembling end 20*b* located at a rear end of the insulating housing 20 and connected with the connecting end 20*a*. The insulating housing 20 is of a substantially rectangular shape. The insulating housing 20 has two arc-shaped lateral surfaces 201, a top surface 202 connected with top ends of the two lateral surfaces 201, a bottom surface 203 opposite to the top surface 202 and connected with bottom ends of the two lateral surfaces 201, a rear surface 204 connected with rear ends of the two lateral surfaces 201, the top surface 202 and the bottom surface 203, and a front surface 205 opposite to the rear surface 204. The insulating housing 20 opens a penetrating groove 21 penetrating through middles of the two lateral surfaces 201 and the rear surface 204, respectively. The penetrating groove 21 penetrate through a front and two opposite sides of the connecting end 20*a*, and a rear end and two opposite sides of the assembling end 20*b*.

The penetrating groove 21 of the insulating housing 20 includes an accommodating space 211 penetrating through the front surface 205 of the insulating housing 20, an insertion groove 22 opened in and penetrating through the rear end of the assembling end 20*b*, and two clamping grooves 24 opened in two sides of the insulating housing 20 and penetrating through the middles of the two lateral surfaces 201 and two sides of the rear surface 204 of the insulating housing 20. The insertion groove 22 is opened in and penetrates through a middle of the rear end of the assembling end 20*b*. The insulating housing 20 opens a plurality of terminal slots 212 recessed oppositely in inner surfaces of a top wall and a bottom wall of the accommodating space 211, and communicated with the accommodating space 211. The two clamping grooves 24 penetrate through rear ends of the two opposite sides of the connecting end 20*a* and the two opposite sides of the assembling end 20*b*. The two clamping grooves 24 is communicated with the accommodating space 211 and the insertion groove 22. Front ends of inner sides of the two clamping grooves 24 penetrate through the rear ends of the two opposite sides of the connecting end 20*a* and are communicated with the accommodating space 211.

The waterproof connector 100 has a plurality of spaced isolating boards 23 disposed in the penetrating groove 21. The insulating housing 20 has the plurality of the spaced isolating boards 23. The plurality of the spaced isolating boards 23 are connected between rears of inner surfaces of a top wall and a bottom wall of the penetrating groove 21. A middle of a rear of each isolating board 23 is recessed frontward to form a portion of the insertion groove 22. A plurality of receiving slots 23*a* are formed among the plurality of the spaced isolating boards 23. The plurality of the receiving slots 23*a* are communicated with the accommodating space 211 and the plurality of the terminal slots 212. The insulating housing 20 has a blocking board 213 disposed horizontally and connected between middles of inner surfaces of two side walls of the penetrating groove 21. The blocking board 213 is spaced from the inner surfaces of the top wall and the bottom wall of the penetrating groove 21, and intersected with middles of the plurality of the isolating boards 23.

In the first preferred embodiment, in order to prevent moisture of external environments permeates into the waterproof connector 100, the plurality of the isolating boards 23 and the blocking board 213 are integrally molded, so junctions between the insulating housing 20 and the plurality of the isolating boards 23 are connected seamlessly for isolating the moisture of the external environments entering the waterproof connector 100 and reducing a probability of liquids entering the waterproof connector 100. In a process of manufacturing the insulating housing 20 together with the plurality of the isolating boards 23 of the waterproof connector 100, a conventional waterproof ring and a manufacture procedure of dispensing glue are omitted, so a manufacture process of the waterproof connector 100 is simplified.

Figure 3:
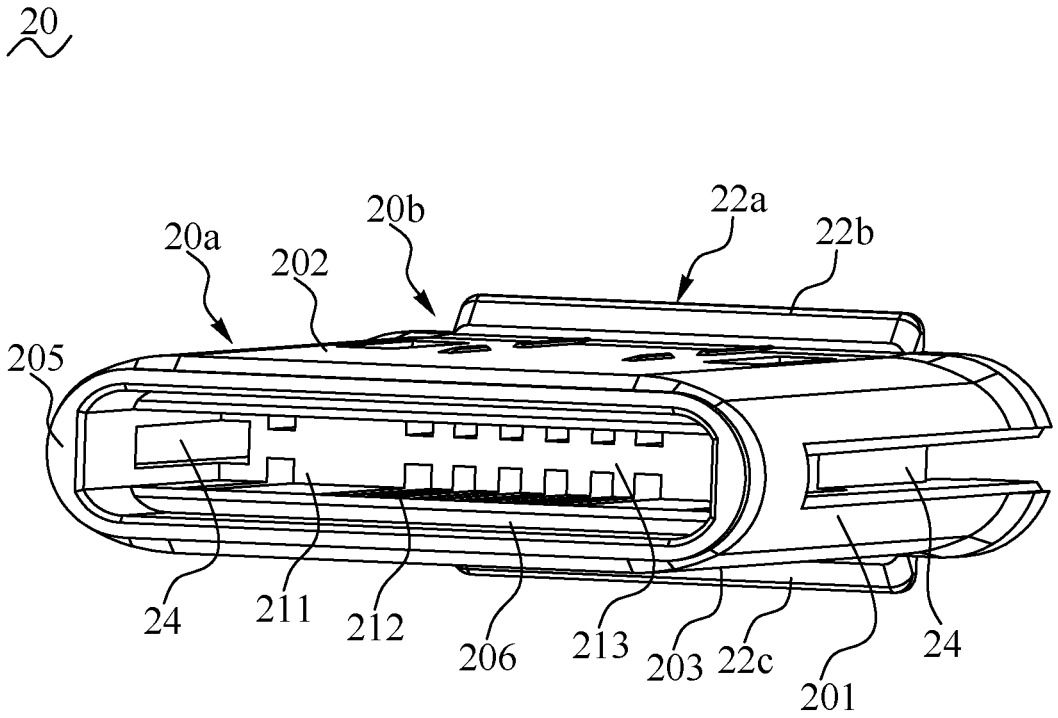
FIG. 3 is a perspective view of an insulating housing of the waterproof connector of FIG. 1.
Figure 4:
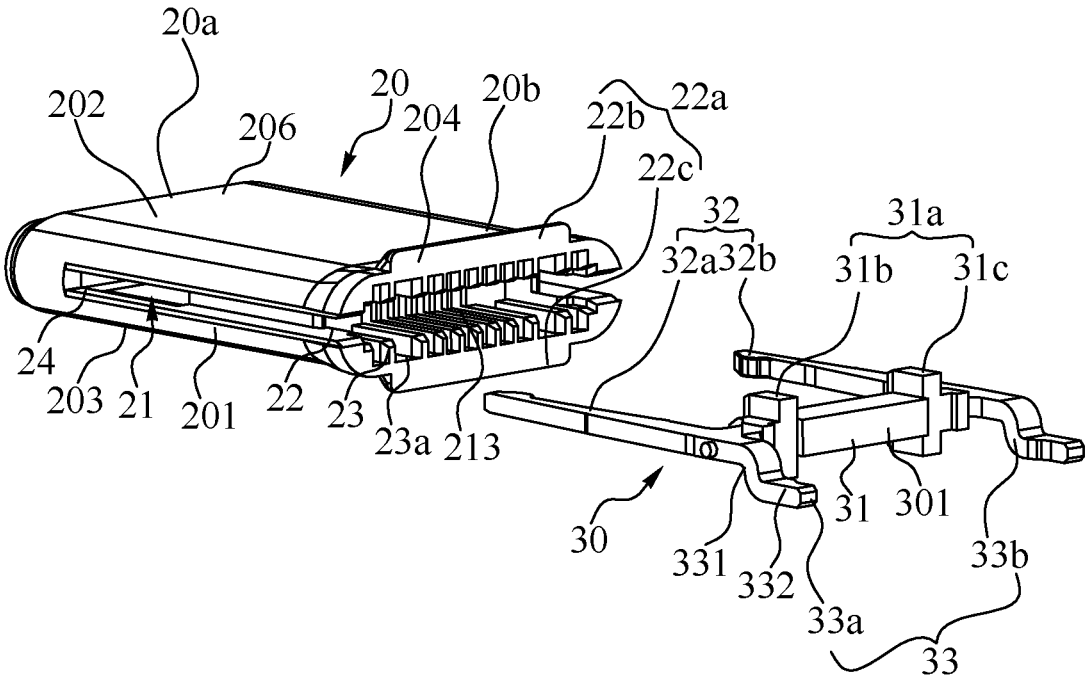
FIG. 4 is a partially exploded view of the waterproof connector of FIG. 1.
Figure 5:
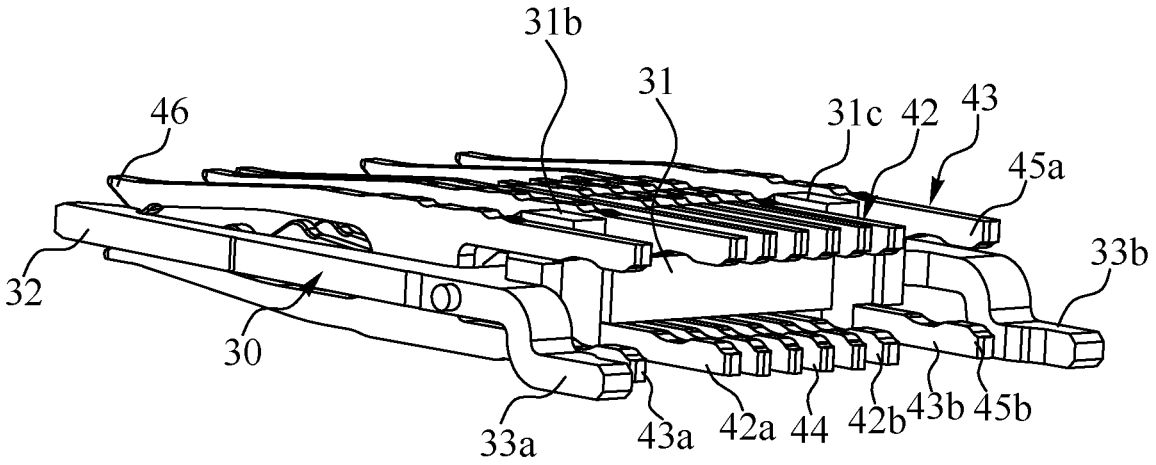
FIG. 5 is a partially perspective view of the waterproof connector of FIG. 1.
Figure 6:
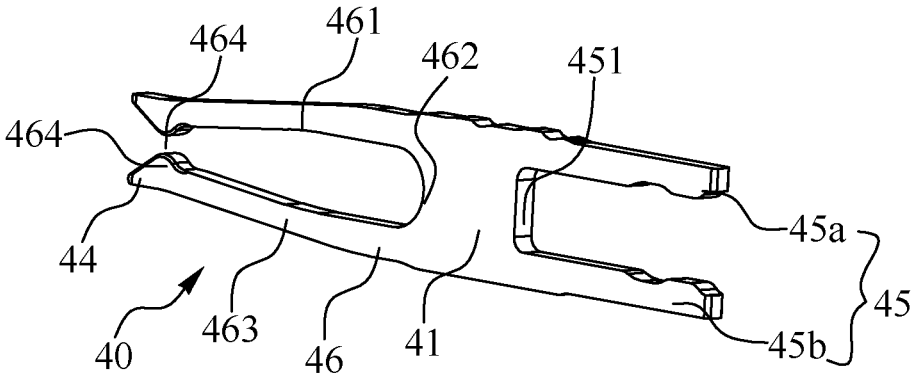
FIG. 6 is a perspective view of a terminal of the waterproof connector of FIG. 1.
Figure 7:
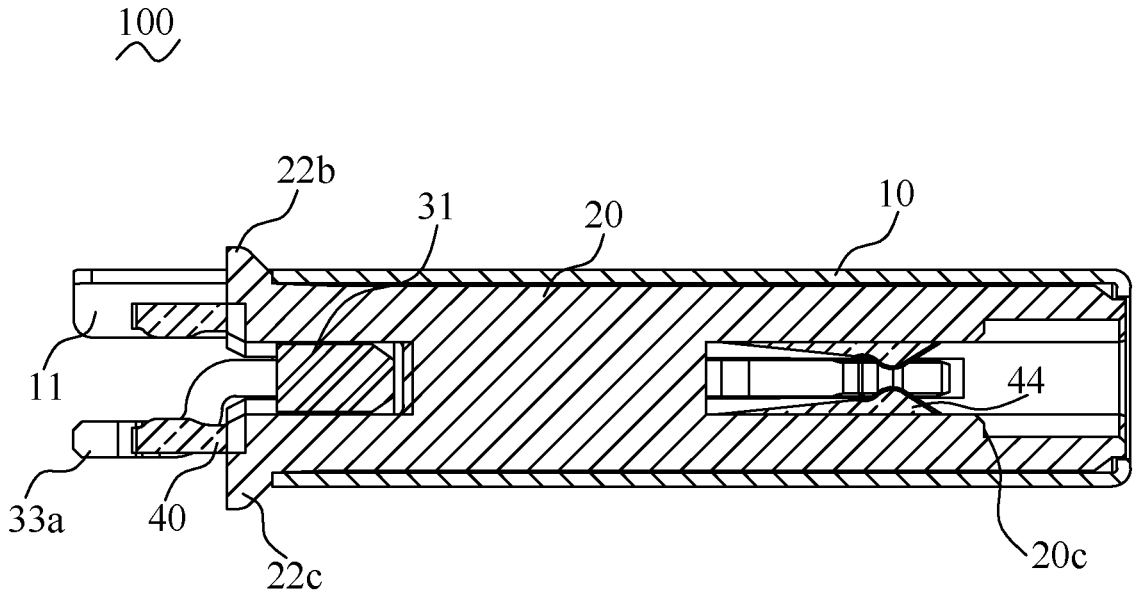
FIG. 7 is a sectional view of the waterproof connector of FIG. 1.

Referring to FIG. 1 to FIG. 4 again, in the first preferred embodiment, the connecting end 20*a* has a hollow connecting portion 206 of which a front is opened freely. The connecting portion 206 is located at a front end of the connecting end 20*a*. In order to further prevent the moisture of the external environments enter the waterproof connector 100 to contact the plurality of the terminals 40, two portions of the inner surfaces of the top wall and the bottom wall of the penetrating groove 21 protrude towards each other to form two protruding boards 20*c* projecting into the accommodating space 211 of the penetrating groove 21 and located in front of the plurality of the isolating boards 23. The two protruding boards 20*c* are located next to an inner side of the connecting portion 206 of the connecting end 20*a*. The plurality of the terminal slots 212 penetrate through the two protruding boards 20*c* and are communicated with the accommodating space 211. The plurality of the terminal slots 212 are isolated from and away from the connecting portion 206 of the connecting end 20*a* by virtue of the two protruding boards 20*c*.

Referring to FIG. 1 to FIG. 7, the plurality of the terminals 40 are assembled to the insulating housing 20. The plurality of the terminals 40 are assembled in the penetrating groove 21. The plurality of the terminals 40 are corresponding to and received in the plurality of the receiving slots 23*a*. The plurality of the terminals 40 are fastened to the plurality of the receiving slots 23*a* by virtue of the spaced isolating boards 23 and the blocking board 213 disposed among the plurality of the receiving slots 23*a*. So the plurality of the terminals 40 are prevented from waggling in the plurality of the receiving slots 23*a*. The plurality of the terminals 40 are isolated from and away from the connecting portion 206 of the connecting end 20*a* by the two protruding boards 20*c*, the plurality of the terminals 40 are allowed to be without being exposed to the connecting portion 206 of the connecting end 20*a* directly, so that the plurality of the terminals 40 are away from an outside of the waterproof connector 100, and an effect of decreasing the moisture of the external environments permeated into the plurality of the terminals 40 of the waterproof connector 100 from the connecting portion 206 is reached. In addition, the two protruding boards 20*c* project into the accommodating space 211 of the waterproof connector 100, a clearance 213 formed between the plurality of the terminals 40 and an inside of the insulating housing 20 is decreased, so that an effect of decreasing the moisture of the external environments permeated into the waterproof connector 100 from the clearance 213 between the plurality of the terminals 40 and the insulating housing 20. Thus, a normal usage and a usage life of the waterproof connector 100 is affected.

Referring to FIG. 1 to FIG. 7, the fastening element 30 is fastened to the insulating housing 20. In the first preferred embodiment, the fastening element 30 includes an isolation part 31. The isolation part 31 is disposed transversely and is inserted into a middle of the insertion groove 22 to seal the insertion groove 22. The isolation part 31 has a connecting block 301 of a rectangular shape, and at least two isolation blocks 31*a* intersecting with at least two portions of the connecting block 301 adjacent to two opposite ends of the isolation part 31, and projecting beyond a top surface and a bottom surface of the connecting block 301. The isolation part 31 has two isolation blocks 31*a* which include a first isolation block 31*b* and a second isolation block 31*c*. A top end and a bottom end of the first isolation block 31*b* oppositely protrude beyond the top surface and the bottom surface of the connecting block 301. A top end and a bottom end of the second isolation block 31*c* oppositely protrude beyond the top surface and the bottom surface of the connecting block 301. The first isolation block 31*b* and the second isolation block 31*c* are disposed adjacent to the two opposite ends of the isolation part 31. The first isolation block 31*b* and the second isolation block 31*c* are symmetrical to each other with respect to a center of the connecting block 301.

Referring to FIG. 1 to FIG. 7, the plurality of the terminals 40 include a positive terminal assembly 42, a negative terminal assembly 43 and a plurality of conductive terminals 44. The positive terminal assembly 42 includes a first positive terminal 42*a* and a second positive terminal 42*b*. The negative terminal assembly 43 includes a first negative terminal 43*a* and a second negative terminal 43*b*. The first positive terminal 42*a* and the first negative terminal 43*a* are disposed adjacent to two opposite sides of the first isolation block 31*b*. The first negative terminal 43*a* is disposed adjacent to one side of the first isolation block 31*b* and adjacent to an inner surface of one side of the insulating housing 20. In a similar way, the second positive terminal 42*b* and the second negative terminal 43*b* are disposed adjacent to two opposite sides of the second isolation block 31*c*. The second isolation block 31*c* is disposed between the second positive terminal 42*b* and the second negative terminal 43*b*. The second negative terminal 43*b* is disposed adjacent to an inner surface of the other side of the insulating housing 20 and disposed opposite to the first negative terminal 43*a*. The plurality of the conductive terminals 44 are located between the first positive terminal 42*a* and the second positive terminal 42*b*. The at least two isolation blocks 31*a* are disposed among the plurality of the terminals 40, at least two terminals 40 are isolated from the other terminals 40 by the at least two isolation blocks 31*a*.

In the first preferred embodiment, the isolation part 31 is integrally molded by a plastic dielectric material, and each isolation block 31*a* is integrally molded by the plastic dielectric material. A creepage distance between the positive terminal assembly 42 and the negative terminal assembly 43 is increased on account of the positive terminal assembly 42 being isolated from the negative terminal assembly 43 by one isolation block 31*a*, so a short circuit phenomenon between the positive terminal assembly 42 and the negative terminal assembly 43 is prevented being caused. A creepage distance between the first positive terminal 42*a* and the first negative terminal 43*a* is increased on account of the first positive terminal 42*a* and the first negative terminal 43*a* being isolated by the one isolation block 31*a*, namely the first isolation block 31*b*. A creepage distance between the second positive terminal 42*b* and the second negative terminal 43*b* is increased on account of the second positive terminal 42*b* and the second negative terminal 43*b* being isolated by the other isolation block 31*a*, namely the second isolation block 31*c*. The first isolation block 31*b* and the second isolation block 31*c* are located between the first negative terminal 43*a* and the second negative terminal 43*b*. So a creepage distance between the first negative terminal 43*a* and the second negative terminal 43*b* is increased on account of the first negative terminal 43*a* and the second negative terminal 43*b* being isolated by the first isolation block 31*b* and the second isolation block 31*c*. So a short circuit phenomenon of the plurality of the terminals 40 is prevented from being caused.

Referring to FIG. 1 to FIG. 8, the outer shell 10 surrounds the integrally molded insulating housing 20 together with the plurality of the terminals 40 and the fastening element 30. In the first preferred embodiment, in order to increase a creepage distance between the positive terminal assembly 42 and the outer shell 10 and improve a safety of using the waterproof connector 100, the insulating housing 20 has a protruding wall 22*a* protruded outward from a top and a bottom of a peripheral surface of the rear end of the insulating housing 20 and located at a top surface of a top wall and a bottom surface of a bottom wall the insertion groove 22, and the insertion groove 22 and the protruding wall 22*a* are exposed out of the outer shell 10. The protruding wall 22*a* of the insulating housing 20 includes a first protruding rib 22*b* protruded upward from a rear end of the top surface of the top wall of the insertion groove 22, and a second protruding rib 22*c* protruded downward from a rear end of the bottom surface of the bottom wall of the insertion groove 22 and opposite to the first protruding rib 22*b*. The insertion groove 22, the first protruding rib 22*b* and the second protruding rib 22*c* are exposed out of the outer shell 10. The first protruding rib 22*b* and the second protruding rib 22*c* are symmetrical to each other with respect to the rear end of the insulating housing 20. The first protruding rib 22*b* and the second protruding rib 22*c* are protruded outward from the peripheral surface of the rear end of the insulating housing 20. A transverse length of the protruding wall 22*a* is equal to a distance between the first isolation block 31*b* and the second isolation block 31*c*, so that a creepage distance between the first positive terminal 42*a* and the outer shell 10 is increased, and a creepage distance between the second positive terminal 42*b* and the outer shell 10 is increased, and then a usage safety of the waterproof connector 100 is improved.

Referring to FIG. 1 to FIG. 8, in the first preferred embodiment, in order to further save work time to make a structure of the waterproof connector 100 more concise, each terminal 40 has a main portion 41 disposed vertically, a lying U-shaped soldering portion 45 connected with one end of the main portion 41 and extending outward, and a lying U-shaped contact portion 46 connected with the other end of the main portion 41, and extending outward and disposed opposite to the soldering portion 45. The soldering portion 45 has a clamping performance. The contact portion 46 has the clamping performance. A mouth of the soldering portion 45 is opposite to a mouth of the contact portion 46.

The soldering portion 45 has a connecting piece 451 connected with a rear end of the main portion 41, an upper soldering portion 45*a* extended rearward from an upper portion of a rear end of the connecting piece 451, and a lower soldering portion 45*b* extending rearward from a lower portion of the rear end of the connecting piece 451 and located under the upper soldering portion 45*a*. The connecting piece 451 is connected between a front end of the upper soldering portion 45*a* and a front end of the lower soldering portion 45*b*. The main portions 41 of the plurality of the terminals 40 are received in the plurality of the receiving slots 23*a*. The contact portions 46 of the plurality of the terminals 40 are received in the plurality of the terminal slots 212 and inner sides of front ends of the plurality of the terminals 40 project into the accommodating space 211.

The connecting piece 451 is connected with the one end of the main portion 41. The connecting piece 451 is connected with the rear end of the main portion 41. The contact portion 46 of each terminal 40 has a connecting slice 462 connected with the other end of the main portion 41, an upper contact portion 461 extended frontward from an upper portion of the other end of the connecting slice 462, and a lower contact portion 463 extended frontward from a lower portion of the other end of the connecting slice 462. The connecting slice 462 is connected with a front end of the main portion 41. The upper contact portion 461 is extended frontward from the upper portion of the front end of the connecting slice 462, and the lower contact portion 463 is extended frontward from the lower portion of the front end of the connecting slice 462. The connecting slice 462 is connected between a rear end of the upper contact portion 461 and the lower contact portion 463. Two facing surfaces of the upper contact portion 461 and the lower contact portion 463 face to face to form two abutting portions 464. The upper contact portion 461 and the lower contact portion 463 slantwise extend frontward and inward to gradually approach each other from rear ends of the upper contact portion 461 and the lower contact portion 463 to front ends of the upper contact portion 461 and the lower contact portion 463. The connecting slices 462, the main portions 41 and the soldering portions 45 of the plurality of the terminals 40 are blocked behind the blocking board 213.

The soldering portion 45 of each terminal 40 clamps a top surface and a bottom surface of the isolation part 31. The upper soldering portion 45*a* of each terminal 40 is disposed to the top surface of the isolation part 31, and the lower soldering portion 45*b* of each terminal 40 is disposed under the bottom surface of the isolation part 31. The soldering portion 45 of each terminal 40 passes through one of the plurality of the receiving slots 23*a* and is exposed out of the insulating housing 20. The circuit board 50 is inserted into the insertion groove 22 and is located between the upper soldering portions 45*a* and the lower soldering portions 45*b* of the plurality of the terminals 40 by virtue of structure designs of the soldering portions 45 of the plurality of the terminals 40, so that the circuit board 50 is capable of proceeding being soldered with the upper soldering portions 45*a* and the lower soldering portions 45*b* of each terminal 40. A procedure of aligning each upper soldering portion 45*a* with one lower soldering portion 45*b* is saved so as to save work time of the waterproof connector 100.

Referring to FIG. 1 to FIG. 8, in the first preferred embodiment, in a later period of manufacturing the waterproof connector 100, in order to improve a yield of the circuit board 50 of which the waterproof connector 100 is mounted on soldering with a cable (not shown), the fastening element 30 includes a clamping portion 32 passing through the insertion groove 22 to project into a front end of the penetrating groove 21 of the insulating housing 20 and playing a clamping function, and a propping portion 33 connected with and opposite to the clamping portion 32, and the propping portion 33 being exposed out from the insulating housing 20. The clamping portion 32 projects into the accommodating space 211. The clamping portion 32 includes a first elastic arm 32*a* and a second elastic arm 32*b*. The isolation part 31 is located between and integrally molded with the first elastic arm 32*a* and the second elastic arm 32*b*. The isolation part 31 is connected with rear ends of the first elastic arm 32*a* and the second elastic arm 32*b*. The first elastic arm 32*a* and the second elastic arm 32*b* are inserted into and pass through the two clamping grooves 24 to be fastened to the two opposite sides of the insulating housing 20 for playing a clamping function.

The propping portion 33 is extended rearward from a rear end of the clamping portion 32. The propping portion 33 is disposed opposite to the clamping portion 32. The propping portion 33 includes a L-shaped first supporting portion 33*a* and a L-shaped second supporting portion 33*b*. The L-shaped first supporting portion 33*a* and the second supporting portion 33*b* are extended downward and then extended rearward from rear ends of the first elastic arm 32*a* and the second elastic arm 32*b*. The first supporting portion 33*a* and the second supporting portion 33*b* are opposite to the first elastic arm 32*a* and the second elastic arm 32*b*, respectively. Each of the L-shaped first supporting portion 33*a* and the L-shaped second supporting portion 33*b* has a connecting bar 331 extended downward from a rear end of one of the first supporting portion 33*a* and the second supporting portion 33*b*, and a supporting bar 332 extended rearward from a bottom of the connecting bar 331 of the one of the first supporting portion 33*a* and the second supporting portion 33*b*. The supporting bar 332 is longer than the connecting bar 331. The first supporting portion 33*a* and the second supporting portion 33*b* are both exposed out of the insulating housing 20 and the outer shell 10. When the soldering portion 45 of each terminal 40 is completed being soldered with the circuit board 50, the circuit board 50 is supported by an increased supporting force generated by virtue of the supporting bars 332 of the first supporting portion 33*a* and the second supporting portion 33*b* of the propping portion 33 supporting two opposite sides of the circuit board 50, respectively, so that a deformation phenomenon or a breakage phenomenon of the circuit board 50 is reduced for improving the yield of the circuit board 50 of which the waterproof connector 100 is mounted on soldering with the cable. The soldering portion 45 of each terminal 40 and the propping portion 33 of the fastening element 30 are exposed out of the outer shell 10.

Referring to FIG. 1 to FIG. 10, the waterproof connector 100 in accordance with a second preferred embodiment of the present invention is shown. Differences between the waterproof connector 100 in accordance with the first preferred embodiment and the waterproof connector 100 in accordance with the second preferred embodiment are described as follows. In the second preferred embodiment, in the later period of manufacturing the waterproof connector 100, in order to improve the yield of the circuit board 50 of which the waterproof connector 100 is mounted on soldering with the cable, at least two portions of a top of the outer shell 10 extend rearward to form at least two soldering feet 11. When the waterproof connector 100 is assembled, the outer shell 10 surrounds the insulating housing 20, the at least two soldering feet 11 are adjacent to the propping portion 33. The at least two soldering feet 11 are disposed opposite to and spaced from the propping portion 33. When the waterproof connector 100 is soldered with the circuit board 50, the circuit board 50 is supported between the at least two soldering feet 11 and the propping portion 33. In the second preferred embodiment, two sides of the top of the outer shell 10 extend rearward to form two soldering feet 11. When the waterproof connector 100 is assembled, the two soldering feet 11 are adjacent to the propping portion 33. The two soldering feet 11 are disposed above and spaced from the propping portion 33. Because a combination design of the at least two soldering feet 11 and the propping portion 33, when either of a top surface and a bottom surface of the circuit board 50 is soldered with the cable, the circuit board 50 is supported by the increased supporting force which is exerted by the propping portion 33 and is exerted an increased bearing force by the at least two soldering feet 11, the deformation phenomenon or the breakage phenomenon of the circuit board 50 is further reduced for improving the yield of the circuit board 50 of which the waterproof connector 100 is mounted on soldering with the cable.

As described above, the waterproof connector 100 saves a procedure of dispensing a waterproof adhesive, and in order to prevent the moisture of the external environments permeating into the waterproof connector 100, the insulating housing 20 having the plurality of the isolating boards 23 and the blocking board 213 is integrally molded, the plurality of the terminals 40 are isolated from and away from the connecting portion 206 of the connecting end 20*a* by the two protruding boards 20*c*, so that the plurality of the terminals 40 are away from the outside of the waterproof connector 100, and the effect of decreasing the moisture of the external environments permeated into the plurality of the terminals 40 of the waterproof connector 100 from the connecting portion 206 is reached, in addition, the two protruding boards 20*c* project into the accommodating space 211 of the waterproof connector 100, the clearance 213 formed between the plurality of the terminals 40 and the inside of the insulating housing 20 is decreased, so that the effect of decreasing the moisture of the external environments permeated into the waterproof connector 100 from the clearance 213. Thus, the normal usage and the usage life of the waterproof connector 100 is affected. Furthermore, the creepage distance between the positive terminal assembly 42 and the negative terminal assembly 43 is increased on account of the positive terminal assembly 42 being isolated from the negative terminal assembly 43 by the one isolation block 31*a*, so the short circuit phenomenon between the positive terminal assembly 42 and the negative terminal assembly 43 is prevented being caused, in order to increase the creepage distance between the positive terminal assembly 42 and the outer shell 10 and improve the safety of using the waterproof connector 100, the insertion groove 22 and the first protruding rib 22*b* and the second protruding rib 22*c* of the protruding wall 22*a* are exposed out of the outer shell 10. Because the combination design of the at least two soldering feet 11 and the propping portion 33, when either of the top surface and the bottom surface of the circuit board 50 is soldered with the cable, the deformation phenomenon or the breakage phenomenon of the circuit board 50 is further reduced for improving the yield of the circuit board 50 of which the waterproof connector 100 is mounted on soldering with the cable. As a result, the waterproof connector 100 has a simple structure and effectively achieves a waterproof effect.

What is claimed is:

1. A waterproof connector, comprising:

an insulating housing integrally molded, the insulating housing having a connecting end, and an assembling end connected with the connecting end, the insulating housing comprising a penetrating groove penetrating through a front end and two opposite sides of the connecting end, and a rear end and two opposite sides of the assembling end, two portions of inner surfaces of a top wall and a bottom wall of the penetrating groove protruding towards each other to form two protruding boards projecting into the penetrating groove, the connecting end having a hollow connecting portion of which a front is opened freely, the two protruding boards being located next to an inner side of the connecting portion, an insertion groove being opened in and penetrating through a middle of a rear end of the assembling end, the insulating housing including a first protruding rib protruded upward from a rear end of a top surface of a top wall of the insertion groove, and a second protruding rib protruded downward from a rear end of a bottom surface of a bottom wall of the insertion groove and opposite to the first protruding rib;

a plurality of terminals assembled in the penetrating groove, each terminal having a main portion disposed vertically, a lying U-shaped soldering portion connected with one end of the main portion and extending outward, and a lying U-shaped contact portion connected with the other end of the main portion, and extending outward and disposed opposite to the soldering portion, the soldering portion having a clamping performance;

a fastening element including an isolation part inserted into a middle of the insertion groove, the fastening element including a clamping portion passing through the insertion groove to project into a front end of the penetrating groove and playing a clamping function, and a propping portion connected with and opposite to the clamping portion, and the propping portion being exposed out from the insulating housing, the soldering portion of each terminal clamping a top surface and a bottom surface of the isolation part, the isolation part having a connecting block, and at least two isolation blocks intersecting with the connecting block and projecting beyond a top surface and a bottom surface of the connecting block, the at least two isolation blocks being disposed among the plurality of the terminals, at least two terminals being isolated from the other terminals by the at least two isolation blocks; and an outer shell surrounding the integrally molded insulating housing, the soldering portion of each terminal and the propping portion of the fastening element being exposed out of the outer shell.

2. The waterproof connector as claimed in claim 1, wherein at least two portions of a top of the outer shell extend rearward to form at least two soldering feet, when the waterproof connector is assembled, the at least two soldering feet are adjacent to the propping portion, the at least two soldering feet are disposed opposite to and spaced from the propping portion, when the waterproof connector is soldered with a circuit board, the circuit board is supported between the at least two soldering feet and the propping portion.

3. The waterproof connector as claimed in claim 1, wherein the insertion groove, the first protruding rib and the second protruding rib are exposed out of the outer shell, the first protruding rib and the second protruding rib are symmetrical to each other with respect to a rear end of the insulating housing.

4. The waterproof connector as claimed in claim 1, wherein the isolation part has two isolation blocks which include a first isolation block and a second isolation block, a top end and a bottom end of the first isolation block oppositely protrude beyond the top surface and the bottom surface of the connecting block, a top end and a bottom end of the second isolation block oppositely protrude beyond the top surface and the bottom surface of the connecting block, the first isolation block and the second isolation block are disposed adjacent to two opposite ends of the isolation part, the first isolation block and the second isolation block are symmetrical to each other with respect to a center of the connecting block.

5. The waterproof connector as claimed in claim 4, wherein the plurality of the terminals include a positive terminal assembly and a negative terminal assembly, the positive terminal assembly includes a first positive terminal and a second positive terminal, the negative terminal assembly includes a first negative terminal and a second negative terminal, the first positive terminal and the first negative terminal are disposed adjacent to two opposite sides of the first isolation block, the second positive terminal and the second negative terminal are disposed adjacent to two opposite sides of the second isolation block, a creepage distance between the first positive terminal and the first negative terminal is increased on account of the first positive terminal and the first negative terminal being isolated by the first isolation block, a creepage distance between the second positive terminal and the second negative terminal is increased on account of the second positive terminal and the second negative terminal being isolated by the second isolation block.

6. The waterproof connector as claimed in claim 1, wherein the clamping portion includes a first elastic arm and a second elastic arm, the isolation part is located between and integrally molded with the first elastic arm and the second elastic arm, the isolation part is connected with rear ends of the first elastic arm and the second elastic arm, the penetrating groove includes two clamping grooves opened in two sides of the insulating housing and penetrating through middles of two lateral surfaces and two sides of a rear surface of the insulating housing, the first elastic arm and the second elastic arm are inserted into and pass through the two clamping grooves to be fastened to two opposite sides of the insulating housing.

7. The waterproof connector as claimed in claim 6, wherein the propping portion includes a L-shaped first supporting portion and a L-shaped second supporting portion extended downward and then extended rearward from rear ends of the first elastic arm and the second elastic arm, the first supporting portion and the second supporting portion are opposite to the first elastic arm and the second elastic arm, respectively, the first supporting portion and the second supporting portion are both exposed out of the insulating housing and the outer shell.

8. The waterproof connector as claimed in claim 7, wherein each of the first supporting portion and the second supporting portion has a connecting bar extended downward from a rear end of one of the first supporting portion and the second supporting portion, and a supporting bar extended rearward from a bottom of the connecting bar of the one of the first supporting portion and the second supporting portion, the supporting bar is longer than the connecting bar, when the soldering portion of each terminal is completed being soldered with a circuit board, the circuit board is supported by an increased supporting force generated by virtue of the supporting bars of the first supporting portion and the second supporting portion of the propping portion supporting two opposite sides of the circuit board, respectively.

9. The waterproof connector as claimed in claim 1, further having a plurality of spaced isolating boards disposed in the penetrating groove, the plurality of the spaced isolating boards being connected between rears of inner surfaces of a top wall and a bottom wall of the penetrating groove, a plurality of receiving slots being formed among the plurality of the spaced isolating boards, the plurality of the terminals being corresponding to and received in the plurality of the receiving slots.

10. The waterproof connector as claimed in claim 9, wherein the penetrating groove includes an accommodating space penetrating through a front surface of the insulating housing, the insulating housing opens a plurality of terminal slots recessed oppositely in inner surfaces of a top wall and a bottom wall of the accommodating space, and communicated with the accommodating space, the plurality of the terminal slots penetrate through the two protruding boards, the plurality of the receiving slots are communicated with the accommodating space and the plurality of the terminal slots, the clamping portion projects into the accommodating space, the main portions of the plurality of the terminals are received in the plurality of the receiving slots, the contact portions of the plurality of the terminals are received in the plurality of the terminal slots and inner sides of front ends of the plurality of the terminals project into the accommodating space.

11. The waterproof connector as claimed in claim 9, wherein the insulating housing has a blocking board disposed horizontally and connected between middles of inner surfaces of two side walls of the penetrating groove, the blocking board is spaced from the inner surfaces of the top wall and the bottom wall of the penetrating groove, and intersected with middles of the plurality of the isolating boards, the contact portion of each terminal has a connecting slice connected with the other end of the main portion, the connecting slices, the main portions and the soldering portions of the plurality of the terminals are blocked behind the blocking board.

12. The waterproof connector as claimed in claim 11, wherein the plurality of the isolating boards and the blocking board are integrally molded.

13. A waterproof connector adapted for being mounted to a circuit board, comprising:

an insulating housing integrally molded, the insulating housing having a connecting end, and an assembling end connected with the connecting end, the insulating housing comprising a penetrating groove penetrating through a front end and two opposite sides of the connecting end, and a rear end and two opposite sides of the assembling end, an insertion groove being opened in and penetrating through a middle of a rear end of the assembling end, the insulating housing including a first protruding rib protruded upward from a rear end of a top surface of a top wall of the insertion groove, and a second protruding rib protruded downward from a rear end of a bottom surface of a bottom wall of the insertion groove and opposite to the first protruding rib;

a plurality of terminals assembled in the penetrating groove, each terminal having a main portion disposed vertically, a lying U-shaped soldering portion connected with one end of the main portion and extending outward, and a lying U-shaped contact portion connected with the other end of the main portion, and extending outward and disposed opposite to the soldering portion;

a fastening element including an isolation part inserted into a middle of the insertion groove, the fastening element including a clamping portion projecting into a front end of the penetrating groove and playing a clamping function, and a propping portion connected with and opposite to the clamping portion, and the propping portion being exposed out from the insulating housing, the soldering portion of each terminal clamping a top surface and a bottom surface of the isolation part, the isolation part having a connecting block, and at least two isolation blocks intersecting with the connecting block and projecting beyond a top surface and a bottom surface of the connecting block, the at least two isolation blocks being disposed among the plurality of the terminals; and an outer shell surrounding the insulating housing, the soldering portion of each terminal and the propping portion of the fastening element being exposed out of the outer shell, at least two portions of a top of the outer shell extending rearward to form at least two soldering feet adjacent to the propping portion, the at least two soldering feet being disposed opposite to and spaced from the propping portion, the circuit board being supported between the at least two soldering feet and the propping portion.

14. A waterproof connector, comprising:

an insulating housing integrally molded, the insulating housing having a connecting end, and an assembling end connected with the connecting end, the insulating housing comprising a penetrating groove penetrating through a front end and two opposite sides of the connecting end, and a rear end and two opposite sides of the assembling end, the insulating housing having a plurality of spaced isolating boards disposed in the penetrating groove, the plurality of the spaced isolating boards being connected between rears of inner surfaces of a top wall and a bottom wall of the penetrating groove, a plurality of receiving slots being formed among the plurality of the spaced isolating boards, an insertion groove being opened in and penetrating through a middle of a rear end of the assembling end, the insulating housing including a first protruding rib protruded upward from a rear end of a top surface of a top wall of the insertion groove, and a second protruding rib protruded downward from a rear end of a bottom surface of a bottom wall of the insertion groove and opposite to the first protruding rib;

a plurality of terminals assembled in the penetrating groove, the plurality of the terminals being corresponding to and received in the plurality of the receiving slots, each terminal having a main portion disposed vertically, a lying U-shaped soldering portion connected with one end of the main portion, and a lying U-shaped contact portion connected with the other end of the main portion and disposed opposite to the soldering portion;

a fastening element including an isolation part inserted into a middle of the insertion groove, the fastening element including a clamping portion passing through the insertion groove to project into a front end of the penetrating groove and playing a clamping function, and a propping portion connected with and opposite to the clamping portion, and the propping portion being exposed out from the insulating housing, the soldering portion of each terminal clamping a top surface and a bottom surface of the isolation part, the isolation part having a connecting block, and at least two isolation blocks intersecting with the connecting block and projecting beyond a top surface and a bottom surface of the connecting block, the at least two isolation blocks being disposed among the plurality of the terminals, at least two terminals being isolated from the other terminals by the at least two isolation blocks; and an outer shell surrounding the insulating housing, the soldering portion of each terminal and the propping portion of the fastening element being exposed out of the outer shell.

15. The waterproof connector as claimed in claim 14, wherein two portions of inner surfaces of the top wall and the bottom wall of the penetrating groove protrude towards each other to form two protruding boards projecting into the penetrating groove, the connecting end has a hollow connecting portion of which a front is opened freely, the two protruding boards are located next to an inner side of the connecting portion, the plurality of the terminal slots penetrate through the two protruding boards, the plurality of the terminals are isolated from and away from the connecting portion of the connecting end by the two protruding boards.

16. The waterproof connector as claimed in claim 15, wherein the penetrating groove includes an accommodating space penetrating through a front surface of the insulating housing, the insulating housing opens a plurality of terminal slots recessed oppositely in inner surfaces of a top wall and a bottom wall of the accommodating space, and communicated with the accommodating space, the plurality of the terminal slots penetrate through the two protruding boards, the plurality of the receiving slots are communicated with the accommodating space and the plurality of the terminal slots, the clamping portion projects into the accommodating space, the main portions of the plurality of the terminals are received in the plurality of the receiving slots, the contact portions of the plurality of the terminals are received in the plurality of the terminal slots and inner sides of front ends of the plurality of the terminals project into the accommodating space.

17. The waterproof connector as claimed in claim 15, wherein the insulating housing has a blocking board disposed horizontally and connected between middles of inner surfaces of two side walls of the penetrating groove, the blocking board is spaced from the inner surfaces of the top wall and the bottom wall of the penetrating groove, and intersected with middles of the plurality of the isolating boards, the contact portion of each terminal has a connecting slice connected with the other end of the main portion, the connecting slices, the main portions and the soldering portions of the plurality of the terminals are blocked behind the blocking board.

18. The waterproof connector as claimed in claim 17, wherein the plurality of the isolating boards and the blocking board are integrally molded.

19. The waterproof connector as claimed in claim 14, wherein the isolation part has two isolation blocks which include a first isolation block and a second isolation block, a top end and a bottom end of the first isolation block oppositely protrude beyond the top surface and the bottom surface of the connecting block, a top end and a bottom end of the second isolation block oppositely protrude beyond the top surface and the bottom surface of the connecting block, the first isolation block and the second isolation block are disposed adjacent to two opposite ends of the isolation part, the first isolation block and the second isolation block are symmetrical to each other with respect to a center of the connecting block.

20. The waterproof connector as claimed in claim 19, wherein the plurality of the terminals include a positive terminal assembly and a negative terminal assembly, the positive terminal assembly includes a first positive terminal and a second positive terminal, the negative terminal assembly includes a first negative terminal and a second negative terminal, the first positive terminal and the first negative terminal are disposed adjacent to two opposite sides of the first isolation block, the second positive terminal and the second negative terminal are disposed adjacent to two opposite sides of the second isolation block, a creepage distance between the first positive terminal and the first negative terminal is increased on account of the first positive terminal and the first negative terminal being isolated by the first isolation block, a creepage distance between the second positive terminal and the second negative terminal is increased on account of the second positive terminal and the second negative terminal being isolated by the second isolation block.

* * * * *